US005691123A

United States Patent [19]

Coltrain et al.

[11] Patent Number: 5,691,123

[45] Date of Patent: Nov. 25, 1997

[54] METHOD TO SELECTIVELY REMOVE LUBRICANT FROM ONE SIDE OF LUBRICANT-COATED SUPPORT

[75] Inventors: Bradley Keith Coltrain, Fairport; Dennis Ray Freeman, Spencerport; David Appler Glocker, West Henrietta, all of N.Y.

[73] Assignee: Eastman Kodak Company, Rochester, N.Y.

[21] Appl. No.: 587,123

[22] Filed: Jan. 11, 1996

Related U.S. Application Data

[60] Provisional application No. 60/000,630, Jun. 30, 1995.

[51] Int. Cl.[6] ..... G03C 11/06; G03C 1/76

[52] U.S. Cl. ..... 430/495.1; 430/523; 430/937; 430/347; 430/496; 430/140; 15/100

[58] Field of Search ..... 430/532, 937, 430/347, 495.1, 496, 140; 15/100

[56] References Cited

U.S. PATENT DOCUMENTS

| | | | |
|---|---|---|---|
| 3,669,709 | 6/1972 | Kasugai et al. | 117/34 |
| 3,712,812 | 1/1973 | Paesschen et al. | 96/1.8 |
| 4,892,634 | 1/1990 | Glocker et al. | 204/192 |
| 4,933,267 | 6/1990 | Ishigaki et al. | 430/501 |
| 5,004,669 | 4/1991 | Yamada et al. | 430/264 |
| 5,061,610 | 10/1991 | Carroll et al. | 430/532 |
| 5,326,689 | 7/1994 | Murayama | 430/530 |
| 5,395,743 | 3/1995 | Brick et al. | 430/496 |
| 5,397,826 | 3/1995 | Wexler | 524/356 |

FOREIGN PATENT DOCUMENTS

| | | | |
|---|---|---|---|
| 1302688 | 1/1973 | United Kingdom | 430/523 |
| 1579002 | 11/1980 | United Kingdom | 430/532 |

OTHER PUBLICATIONS

Research Disclosure 36544, no. 365, pp. 501–541, Sep. 1994.

*Primary Examiner*—Mark F. Huff
*Attorney, Agent, or Firm*—J. Lanny Tucker

[57] ABSTRACT

Elements having a support with lubricant on both sides can be treated to remove substantially all of the lubricant from one side only. Various chemical, mechanical and electrical treatments are contemplated, but glow discharge treatment is particularly useful. Photographic film supports having one or more layers applied thereto can be treated in this manner before or after annealing so that lubricant present on the treated side does not reduce adhesion of later applied silver halide emulsion layers.

27 Claims, 1 Drawing Sheet

METHOD TO SELECTIVELY REMOVE LUBRICANT FROM ONE SIDE OF LUBRICANT-COATED SUPPORT

This application claims the benefit of U.S. Provisional Application No. 60/000,630, filed Jun. 30, 1995.

FIELD OF THE INVENTION

This invention relates to a method for treating lubricant-coated supports. Generally, it relates to selective removal of lubricant from one side of films or papers useful in the preparation of photographic elements. In a specific embodiment, this invention relates to a method for treating film or paper supports using glow discharge to selectively remove lubricants from one side thereof.

BACKGROUND OF THE INVENTION

Polymeric films, such as those prepared from polyesters, generally adopt what is known as a "core set" or induced "curl" when they are wound as rolls around small cores in film cartridges and stored for extended periods of time. Core set is undesirable for a number of reasons, particularly if the film is used in film cartridges with no exposed leader. The film is difficult to pull or thrust out of the cartridge. It is well known to reduce or eliminate core set by annealing the film, that is heating it for an extended time at about 20° C. below its glass transition temperature.

Generally, annealing is done early in the manufacturing process, either on the uncoated polymeric film, or after a minimal number of coatings have been applied to the support. Care must be taken to anneal large rolls of polymeric film at the proper time because heating the roll with the backside in contact with the frontside can cause undesirable transfer of materials from one side to the other. Additionally, undesirable adherence of the one side to the other, known as "blocking", can occur without proper care taken to prevent it.

The need to control the timing of the annealing step creates manufacturing difficulties. The least problems are caused by annealing the bare (that is, uncoated) film support. However, this requires that subbing or other layers be applied to stretched or "oriented" film supports, which creates a more difficult challenge of providing adequate adhesion of those layers to film supports.

Alternatively, a manufacturing process could include extrusion of the film support, application of subbing layers, stretching and application of more coatings, if desired, prior to annealing. This is less expensive than producing the film support on one machine, then removing it and using one or more other machines for annealing and application of coatings. Depending upon the number of coatings needed, especially on the backside of the support, the support might have to be processed on a number of machines or require multiple passes on the same machine. It would be particularly desirable then to anneal after as many of the coatings had been applied to the support on a single machine.

It is known to prepare photographic elements having magnetic recording layers on one side of the polymeric film support. Such magnetic recording layers are preferably transparent as described, for example in U.S. Pat. No. 5,395,743 (Brick et al) and U.S. Pat. No. 5,397,826 (Wexler) so that images can be recorded by the conventional photographic process while at the same time recording information in the magnetic layer.

Elements having magnetic recording layers are transported in cameras and across magnetic heads frequently so they must be durable and have sufficient abrasion and scratch resistance. Generally, a lubricant such as a fatty acid ester (for example, butyl stearate), is applied to the magnetic layers to facilitate element transport.

However, if such lubricants are applied to the elements prior to annealing in large rolls, the lubricant is likely to transfer from the backside to the frontside of the support. Transferred lubricant reduces adhesion of subsequently coated layers, such as subbing or photographic emulsion layers, to the point of causing adhesion failure. Of necessity, such layers must be coated after annealing so adhesion is not adversely affected. Thus, it has been conventional to anneal polymeric films early in the manufacturing process, particularly before application of most backside coatings including magnetic coatings. This causes manufacturing inefficiencies as pointed out above.

It would be desirable to have a manufacturing process in which annealing can occur after most or all backside layers have been applied to the element support, and to have a means for removing any lubricant undesirably transferred from one side of the support to the other. It would also be desirable to have a coating and treating process for element manufacture that can be carried out using few machines, thereby increasing manufacturing efficiencies considerably.

SUMMARY OF THE INVENTION

The problems noted above with the conventional manufacturing processes have been overcome with a method for preparing an element comprising a support having on both sides thereof a lubricant providing a coefficient of friction of less than about 0.5.

the method comprising treating the support in a manner such that substantially all of the lubricant is removed from only one side thereof.

In a preferred embodiment, one side of the support described above is treated with glow discharge in a manner such that only one side is exposed to the treatment for a time and at an energy level sufficient to remove substantially all of the lubricant from that one side of the support.

The present invention provides a process for preparing an element having a support for subsequent coatings by removing unwanted or excess lubricant from one side thereof in a suitable manner, preferably by glow discharge treatment. In particular, this enables an element manufacturer to coat desired layers on a polymeric film support, anneal the coated element support in large rolls, and remove any transferred lubricant from one side of the support before subsequent coatings. This invention is particularly useful for preparing photographic films having magnetic recording layers and lubricant overcoats on the backside thereof, but other useful embodiments are described below.

By careful control of the support treatment, described in detail below, the lubricant can be sufficiently removed from one side to provide adhesion of subsequently coated layers to the support on the treated side. This side has essentially the same properties as if it had never had lubricant thereon. In addition, the treatment is controlled so that only the one side of the support is so treated because it is desired that the lubricant remain on the untreated side.

BRIEF DESCRIPTION OF THE DRAWINGS

The FIGURE shows the layer arrangement of a preferred element that can be treated according to the present invention.

DETAILED DESCRIPTION OF THE INVENTION

Figure 1:
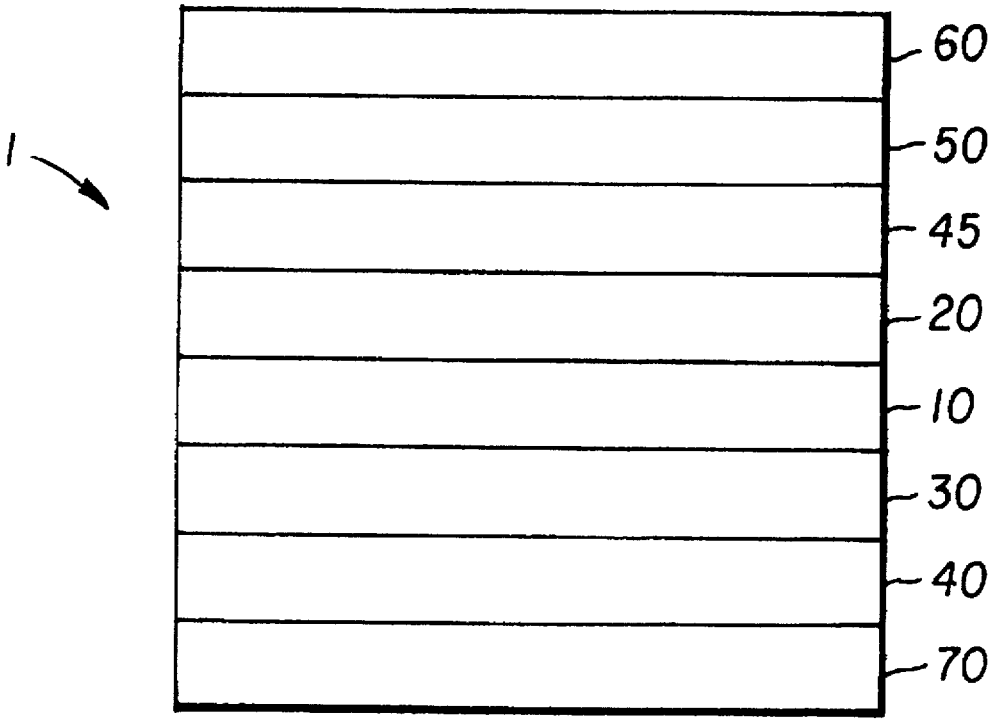

A wide variety of elements can be treated using the method of this invention. These elements can have a wide variety of industrial uses, including but not limited to, magnetic recording materials, packaging materials and decorative materials. Preferably, the elements processed in the practice of this invention have usefulness in the preparation of radiation sensitive elements or imaging elements, including but not limited to, photographic silver halide elements, electrophotographic elements, electrographic elements, graphic arts elements, lithographic plates, electrostatographic elements and others readily apparent to one skilled in the imaging arts. Photographic silver halide elements are most likely prepared using the present invention. While the following discussion will be directed primarily to photographic elements, it is not the inventors' intention to limit their invention thereto.

Photographic elements having a support and one or more silver halide emulsion layers are well known in the art. A detailed description of such materials is found, for example, in *Research Disclosure,* publication 36544, pages 501–541 (September 1994). *Research Disclosure* is a publication of Kenneth Mason Publications Ltd., Dudley House, 12 North Street, Emsworth, Hampshire PO10 7DQ England (also available from Emsworth Design Inc., 121 West 19th Street, New York, N.Y. 10011). This reference will be referred to hereinafter as "*Research Disclosure*". More details about such elements are provided hereinbelow.

The elements contemplated in the practice of this invention comprise a double-sided, generally flat support that is composed of a material that is inert to water and most common organic solvents. Generally, such materials are natural or synthetic polymeric films (homogeneous, blends or composites) or cellulosic papers (including resin-coated and uncoated papers). Such materials are prepared using conventional materials and procedures. Generally, the supports have a thickness of at least about 12 μm, and more preferably, the thickness is from about 75 to about 150 μm. Polymeric films and resin-coated papers are the most likely elements treated in the practice of this invention.

Photographic papers are one class of useful supports, the details of which are provided, for example in Research Disclosure, supra, paragraphs XV(5) & (6) and references noted therein. These papers can be subbed or unsubbed, and may contain conventional pigments, UV absorbers, sizing agents and other materials readily apparent to one skilled in the art.

Preferably, the supports are homogeneous (single material) polymeric films composed of, for example, cellulose nitrate, cellulose esters (such as cellulose triacetate, cellulose diacetate, cellulose propionate, cellulose butyrate and cellulose acetate propionate), polyesters of dibasic aromatic carboxylic acids with divalent alcohols (such as polyethylene terephthalate, polyethylene naphthalate, poly-1,4-cyclohexanedimethylene terephthalate, polyethylene 1,2-diphenoxyethane-4,4'-dicarboxylate, polybutylene terephthalate), polyamides (such as nylons), homo- and copolymers of vinyl chloride, poly(vinyl acetal), polycarbonates, homo- and copolymers of styrene, polyolefins (such as high and low density polyethylene and polypropylene), polyacrylates and polyimides. Further details of these various classes of polymeric materials are provided in *Research Disclosure,* supra, paragraphs XV(4) & (7)–(9) and references noted therein.

Particularly useful polymeric films are composed of polyesters such as polyethylene terephthalate, polyethylene naphthalate, poly-1,4-cyclohexanedimethylene terephthalate, polyethylene 1,2-diphenoxyethane-4,4'-dicarboxylate and polybutylene terephthalate. Polyethylene terephthalate and polyethylene naphthalate are more preferred, and polyethylene naphthalate is most preferred.

Polymeric film supports can be prepared using conventional techniques and starting materials, and can contain any of the conventional addenda included for various purposes, including but not limited to, antioxidants, plasticizers, dyes, UV absorbers, pigments and fillers, as described for example in *Research Disclosure,* supra, paragraph XV(8) and references noted therein.

When the noted support is treated as described below, it has a lubricant (or mixture thereof) on at least one side, and presumably on both sides. That lubricant can be in the form of a uniform coating, or it may be present in a nonuniform manner, such as in regular or irregular patterns, stripes, dots, streaks or other forms readily apparent to one skilled in the art. Generally, the support is purposely coated with the lubricant on one side thereof to form a uniform coating, and in the course of handling, storage or other processing of the coated support (such as annealing a film roll), lubricant from the coated side is rubbed off or transferred to the other side of the support. It is this transferred lubricant that the present invention is intended to selectively remove while leaving the lubricant on the coated side.

The lubricant can be a single material or a mixture of two or more materials as long as the eventual coating provides a coefficient of friction of less than about 0.5, preferably of less than about 0.3, and more preferably, of less than 0.2. Coefficient of friction is determined using a conventional paper clip friction test described, for example, in ANSI IT 9.4-1992.

The amount of lubricant purposely applied to the untreated side of the element support that is not treated is generally less than about $5\times10^{-2}$ g/m$^2$ and amounts of from about $4\times10^{-3}$ to about $3\times10^{-2}$ g/m$^2$ are more likely.

The amount of lubricant on the treated side of the support, prior to treatment, is generally less than about $10^{-2}$ g/m$^2$, although greater amounts may be present in certain instances. During treatment (as described below), substantially all, or at least about 80% of the lubricant is removed from the treated side. Preferably, at least about 90%, and more preferably, at least about 95% of the lubricant is removed. In other words, the coefficient of friction of the treated side of the support, after treatment, is substantially the same as the coefficient of friction of the same support on which no lubricant has been applied or transferred, within a variability of ±20%.

Useful lubricants that can be used singly or in combination include, but are not limited to, silicone oils or waxes/(including silicone oil, silicones having polar groups, fatty acid-modified silicones, and fluorine-containing silicones), fluorine-containing alcohols, fluorine-containing esters or ethers, fluorinated polyalkanes, polyolefins, polyglycol alkyl phosphates or alkali metal salts thereof, polyphenyl ethers, fluorine-containing alkylsulfates or alkali metal salts thereof, monobasic fatty acids having 10 to 24 carbon atoms (branched or linear, saturated or unsaturated) or metal (alkali metals or copper) salts thereof, mono- or polyvalent alcohols having 12 to 22 carbon atoms (branched or linear, saturated or unsaturated), alkoxy alcohols having 12 to 22 carbon atoms, mono-, di- or triesters of monobasic fatty acids having 10 to 24 carbon atoms (branched or linear, saturated or unsaturated), fatty acid esters of monoalkyl ethers of alkylene oxide polymers, fatty acid amides having 8 to 22 carbon atoms (branched or linear, unsaturated or saturated) or aliphatic amines having 8 to 22 carbon atoms (branched or linear, unsaturated or saturated, and optionally interrupted by one or more carbonyl, oxy, amino, thio, carbonyoxy, oxycarbonyl or carbonamide groups). Mixtures of compounds within any group noted above, or mixtures of compounds from two or more groups are also useful. Mixtures are likely since many of these materials are commercially available as such.

Specific examples of useful lubricants include, but are not limited to, lauric acid, myristic acid, palmitic acid, stearic acid, behenic acid, butyl stearate, oleic acid, linolic acid, linolenic acid, elaidic acid, octyl stearate, amyl stearate, isooctyl stearate, octyl myristate, butoxyethyl stearate, anhydrosorbitan monostearate, anhydrosorbitan distearate, anhydrosorbitan tristearate, pentaerythrityl tetrastearate, oleyl alcohol and lauryl alcohol, and mixtures thereof. A preferred lubricant is commercially available carnauba wax which is a mixture of such materials. It is also preferred that this lubricant be used in combination with a preferred support material, polyethylene naphthalate.

The lubricant can be applied to a bare support, or applied as an overcoat to one or more already applied layers (described below) on the support. It is particularly preferred that the lubricant be applied as an overcoat on a magnetic recording layer on a polymeric film support. Such a layer is described in more detail below. It is also possible to use the lubricant as a "binder material" for various addenda on a support.

The support described above having lubricant on both sides in treated in such a manner that substantially all of the lubricant is removed from one side only, and little or no lubricant is removed from the opposite side. Various methods of treatment of a chemical, mechanical or electrical nature can be used, or any combination of these. For example, chemical treatments include the use of organic solvents (such as toluene, methanol and acetone) which will dissolve the lubricant. The support can also be treated with activated gases (such as noble gases) or nitrous oxide at elevated temperatures.

Electrical treatments include corona discharge, flaming and electrode discharge processes that are also well known in the art, for example, as described in *Adhesive Bonding*, Lee (Ed.), Plenum Press, New York, pages 265–267, 1991. A combination treatment of a chemical and electrical means comprises the use of a radio frequency electromagnetic field in the presence of a reactive gas.

All of the foregoing processes are well known, but in the practice of this invention, they would be readily adapted by the skilled artisan, using the teaching herein, to selectively remove lubricant from only one side of the support. Thus, since many of the noted processes are used in the art for modifying support surfaces to improve adhesion, modifications in those processes may be needed to actually decompose the molecules of lubricant rather than merely modify the support surface. Higher energy levels or different treatment times, frequencies, gases or chemicals may be needed to accomplish the desired result. However, it is believed that these modifications can be readily accomplished by a skilled artisan with routine experimentation. In addition, modifications would be necessary to treat only one side of the support, not both. In such instances, the untreated side could be covered, blocked or otherwise excluded from the treatment environment.

The preferred method of treatment in the practice of this invention is glow discharge. Like other treatment methods, glow discharge has been used for many years to treat polymeric films to increase the adhesion of materials applied thereto (see for example, Lister et al, *Journal 4 Adhesion Science and Technology* 10., 1091–1127, 1993 and U.S. Pat. No. 4,933,267 of Ishigaki et al). In the present invention, however, it is used to remove lubricant on one side of a support (such as a polymeric film), particularly lubricant that has transferred from one side of the support to the other.

Glow discharge occurs by applying a high electrical potential to a pair of metal plates or rods disposed at a definite interval in a vacuum chamber. The electrodes, however, can be of any suitable configuration and surface area. Further details about this process are provided in, for example, U.S. Pat. No. 4,892,634 (Glocker et al), incorporated herein by reference with respect to the glow discharge subject matter. The specific configuration, energy level and time of application are critical to achieving the results of the present invention so that substantially all of the lubricant is removed from one side only. Those parameters will depend to some extent on the composition of the lubricant and the composition and pressure of the gases in the vacuum chamber. However, they can be readily determined from routine experimentation using the specific teaching herein as a guide.

More specifically, the treatment equipment and process are designed so that only the one side of the support is exposed to the necessary energy. Typically, the support having lubricant thereon is passed through a glow discharge zone in which the appropriate plasma is allowed to decompose the lubricant on only one side while the opposite side is "blocked" in some manner from being treated. One way of "blocking" one side is to transport the element in contact with a rotating drum or roller. Alternatively, a blocking plate can be spaced near the side to be protected in order to extinguish the plasma.

The gas used to generate the plasma can be any gas than can be used at suitable energy and time to decompose the chemical structure of the lubricant, and essentially cause it to evaporate. Useful gases include, but are not limited to, oxygen, nitrogen, carbon dioxide, ammonia, argon, nitrous oxide, and compatible mixtures thereof. Nitrogen and oxygen are preferred, and a mixture of nitrogen and oxygen (such as 50:50 molar mixture) is most preferred. Compatible mixtures of gases are those in which the individual gases are present in amounts that do not react to form harmful products, or to reduce the efficiency of the plasma.

The gaseous pressure in the vacuum chamber is generally considerably less than atmospheric pressure, unlike many known treatment processes. Thus, the gaseous pressure can be as low as about 0.001 Torr and as high as about 100 Torr. Preferably, the pressure is from about 0.05 to about 2 Torr, and more preferably it is from about 0.05 to about 0.25 Torr.

The time and energy of glow discharge treatment necessary for successful removal of the lubricant will vary depending upon the amount and nature of the lubricant to be removed, the type of support it is on, the gas used to generate the plasma and other factors readily apparent to one skilled in the art. With the teaching provided herein, a skilled artisan would be able to find suitable treatment conditions to achieve the desired result with only routine experimentation.

The time for treatment can be regulated by moving the support through the glow discharge zone at a suitable rate. Generally, the treatment time is at least about 0.1 second with times of from 0.1 to 10 seconds being likely. Preferably, the treatment time is from about 2.5 to about 10 seconds. As would be understood, higher treatment times may be needed in certain circumstances (for example, if the amount of lubricant to be removed is great).

The area and configurations of the electrodes can be whatever is suitable for a given width of film, film speed and lubricant coating level. This would be readily apparent to one skilled in the art, particularly in view of the specific teaching herein.

The source of electrical energy can be either direct or alternating current (up to 30 MHz), but 40 kHz current is preferred. The level of power must be at least about 0.5 joules/cm$^2$. The maximum energy level can be considerably higher, but typically 6 joules/cm$^2$ is the maximum used for practical reasons. A preferred range of energy is from about 0.1 to about 2 joules/cm$^2$.

As described above, the element treated according to the present invention can be any article useful in a variety of industries, but the preferred embodiment of this invention is the treatment of a photographic paper or film support. In such embodiments, after treatment to remove the lubricant from one side, the element would be further processed to apply one or more radiation sensitive and non-radiation sensitive layers, all of which are described in more detail below. In particular, at least one radiation sensitive layer is applied to the treated side of the support, after which additional layers can also be applied. More preferably, prior to treatment to remove lubricant, the element has one or more layers applied thereto, other than the lubricant. Such layers can include, but are not limited to, subbing layers, antihalation layers, antistatic layers and magnetic recording layers. In addition, one or more layers can serve dual functions. For example, the magnetic recording layer can also contain charged agents so that it serves as an antistatic layer. These features are readily apparent to one skilled in the photographic arts.

It is also preferred that where the support is a polymeric film, the element is annealed after treatment to remove the lubricant, using conventional annealing techniques.

Thus, in Embodiment I of this invention, a photographic element is prepared by:

A) providing a synthetic polymeric film support having on both sides thereof a lubricant as described above, B) treating one side of that film support to remove substantially all of the lubricant from that side only, preferably the treatment being by glow discharge, and C) coating a radiation sensitive layer on the treated side of the film support.

In still another Embodiment II of the invention, a photographic element is prepared by:

A) providing a synthetic polymeric film support having on one or both sides thereof a lubricant as described above, B) rolling up the polymeric film support having the lubricant, C) treating one side of the support to remove substantially all of the lubricant from that side, and D) applying one or more radiation sensitive and one or more non-radiation sensitive layers to at least the treated side of the support.

A preferred Embodiment III of this invention comprises preparing a photographic film by:

A) providing a synthetic polymeric film support having on both sides thereof a lubricant as described above, B) annealing the support, C) treating the annealed support to remove lubricant from one side only, and D) applying one or more radiation sensitive layers and one or more non-radiation sensitive layers.

In Embodiment III identified above, before step A, the film support is additionally processed to apply one or more subbing layers on one or both sides, and on the side opposite that to be treated in step C, applying in order, a subbing layer, an antistatic layer, a magnetic recording layer and a lubricant as described herein.

Referring to FIG. 1, element 1 comprises polymeric film support 10 having thereon the same or different synthetic polymer subbing layers 20 and 30, [such as a poly (acrylonitrile-co-vinylidene chloride-co-acrylic acid)], gelatin subbing layer 40, antistatic layer 45, magnetic recording layer 50, and lubricant layer 60 on the backside of support 10. Lubricant layer 70 on the frontside of support 10 is undesirable and can be removed using the present invention.

The various layers applied before or after treatment of the element according to this invention are generally well known in the art. For example, the radiation sensitive layers (either color or black and white), their composition and methods of formulation are well known, being described for example, in *Research Disclosure,* supra and the hundreds of references described therein. Both negative and reversal photographic films and photographic papers are contemplated. The emulsions in such layers can be composed of various silver halides including, but not limited to, silver chloride, silver bromide, silver bromochloride, silver bromoiodide, silver chlorobromide, silver bromochloroiodide, and others readily apparent to one skilled in the art.

The noted *Research Disclosure,* supra also describes useful subbing layers, antihalation layers, antistatic layers, interlayers, cover layers, coating techniques, dispersions processes, and a wide range of materials, embodiments and preparatory procedures. The teaching of *Research Disclosure,* supra is incorporated herein by reference in its entirety for its teaching of photographic materials.

Formulations for preparing magnetic recording layers are also well known in the art, as described for example, in U.S. Pat. No. 5,395,743 (Brick et al) and U.S. Pat. No. 5,397,826 (Wexler), both incorporated herein by reference. Extensive details of such layers are found in these references, but a general description is included herein because of the preference for such layers in the elements treated in accordance with the present invention.

The magnetic recording layers generally include a dispersion of ferromagnetic particles in a suitable binder. Preferably, the binder is transparent so the layer is transparent, but this is not essential. As might be expected, it is highly desirable that the magnetic recording layer not only exhibit desired magnetic and photographic performance, but that it also be highly durable, abrasion resistant and scratch resistant.

Suitable ferromagnetic particles would be readily apparent to one skilled in the art. They include, but are not limited to, ferromagnetic iron oxides (such as $\gamma$-$Fe_2O_3$ or $Fe_3O_4$) with or without cobalt, zinc or other metals in solid solution or surface treated, ferromagnetic chromium dioxides with or without metallic elements or halogen atoms in solid solution. Ferromagnetic metal pigments with an oxide coating on their surface to improve their chemical stability or to improve dispersibility as is commonly employed in conventional magnetic recording, may also be used if desired. In addition, magnetic oxides with a thicker layer of lower refractive index oxide or other material having a lower optical scattering cross-section can be used. Cobalt doped $\gamma$-iron oxide is the preferred ferromagnetic material useful in the practice of this invention.

The magnetic recording layer typically contains one or more transparent binders, dispersant-cobinders, optional non-magnetic particulate materials, grind solvents, coating aids, surfactants, crosslinking agents, catalysts and other conventional addenda for such layers. The amounts and proportions of the various components of such layers are also known in the art.

unless otherwise identified herein, as used herein to modify various amounts, conditions or dimensions, the term "about" refers to a variability of ±10% of the indicated value.

The following examples are used to illustrate the practice of the invention, but are not intended to limit its scope in any way. Unless otherwise indicated, percentages are by weight.

MATERIALS AND METHODS FOR EXAMPLES

The "paper clip" friction test used in the examples below was carried out as described in ANSI IT 9.4-1992.

The "wet adhesion" and "dry adhesion" tests described below were carried out as follows: The glow discharge treated side of the element was coated with a gelatin formulation containing black silver (6%) to provide a gelatin layer on the treated side. This gelatin layer is similar to that conventionally used as an antihalation layer under photographic emulsion layers in color negative photographic elements. The gelatin layer also contained addenda commonly used in such antihalation layers.

The layer was applied at about 32° C., then cooled to and dried at about 16° C. It was then cured at 32.2° C. and 50% relative humidity for 24 hours to provide a dry thickness of 16–18 μm.

Dry adhesion of the coated subbing layer to the treated support was evaluated by cutting the coating in a cross-hatched pattern with a razor blade, applying a piece of SCOTCH™ brand 610 adhesive tape, removing the tape and qualitatively determining the amount of coating removed by the tape.

The wet adhesion test provides an indication, in percentage, of the amount of coating removed from the treated side of the element. It is carried out in the following steps. The subbing coated samples were cut to 35 mm by 12.7 cm strips and soaked in a conventional photographic color developer (to simulate actual photoprocessing conditions) for 3 minutes and 15 seconds at 38° C. Each sample was then scribed in the width direction and placed in an abrasion apparatus (as described below), with color developer covering the sample. The abrasion apparatus included an arm having a rubber pad about 3.5 cm in diameter attached to its end. A 900 g weight is applied to the arm and the pad is then mechanically rubbed perpendicularly to the scribed line on the sample for 100 cycles at a speed of 60 cycles per minute. Three replicates were run for each test. The amount of subbing coating removed, if any, was measured using a grid to determine the percentage.

The rating for the wet adhesion test is as follows:

| | |
|---|---|
| 0 | no coating removed, excellent wet adhesion, |
| 1–5 | minimal coating removed, very good wet adhesion, |
| 5–25 | fair wet adhesion, |
| 26–75 | poor wet adhesion, and |
| 76–100 | extremely poor wet adhesion. |

Generally, the glow discharge treatment was carried out under various energy conditions using various gases bypassing the element past one or more electrode plates (dimensions of 25×32 cm) at various distances in a diffusion pumped chamber having a base pressure of $2\times10^{-4}$ Torr or less. The element was moved at a speed of 1.2 m/min. To insure that only one side of the element was treated, the "backside" of the element (side with the magnetic recording layer) was "blocked" from treatment by a metal plate placed near the element backside. This plate prevented the plasma from reaching that side of the element.

Example 1

The present invention was demonstrated by various glow discharge treatments of the following element:

A poly(ethylene terephthalate) support had the following layers on the "frontside" thereof, in order:

a) a poly(acrylonitrile-co-vinylidene chloride-co-acrylic acid) subbing layer, and b) the 16–18μ gelatin layer as described above.

On the opposite "backside" of the support were, in order:

a') a poly(acrylonitrile-co-vinylidene chloride-co-acrylic acid) subbing layer, b') an antistatic layer of vanadium pentoxide dispersed in a poly(acrylonitrile-co-vinylidene chloride-co-acrylic acid) binder, c') a transparent magnetic recording layer composed of cobalt doped y-ferric oxide particles, and α-alumina abrasive particles in a cellulose diacetate binder, and d') a layer of carnauba wax (about $2.1\times10^{-2}$ g/m$^2$).

This element was wound into a roll and annealed at 100° C. for 72 hours. During this annealing time, carnauba wax from the "backside" of the element transferred or rubbed off onto the "frontside" of the element (that is, onto the 16–18μ gelatin layer). It is this lubricant that is undesirable because it will reduce adhesion of any layers (such as radiation sensitive layers) applied to the "frontside".

Samples of the annealed element were then treated with glow discharge under the various conditions described in Table I below. The "backside" of the element was not treated. It was protected from the glow discharge by blocking with a metal plate placed about 0.5 mm from the element.

After glow discharge treatment, the element samples were tested for lubricity using the "paper clip" friction test described above. After the noted subbing coating had been applied to the treated gel subbing layer, adhesion to the treated side was evaluated using the "dry adhesion" and "wet adhesion" tests described above.

Table I below provides the results of these experiments.

TABLE I

| Experiment | Element Speed (m/min) | Chamber Pressure (Torr) | Energy (joules/cm$^2$) | Gas in Chamber | Blocking Plate* | COF** Frontside | COF** Backside | Dry Adhesion‡ | Wet Adhesion‡ |
|---|---|---|---|---|---|---|---|---|---|
| 1 | 1.2 | 0.100 | 6.0 | Oxygen | 10.2 | 0.49 | 0.29 | 0 | 0 |
| 2 | 4.8 | 0.124 | 6.0 | Oxygen | 10.2 | 0.41 | 0.20 | <1 | 0 |
| 3 | 1.2 | 0.100 | 6.0 | Oxygen | 11.8 | 0.46 | 0.19 | <1 | 0 |
| 4 | 4.8 | 0.129 | 6.0 | Oxygen | 11.8 | 0.50 | 0.17 | 0 | 0 |
| 5 | 15.0 | 0.120 | 0.50 | Oxygen | 11.8 | 0.46 | 0.16 | 45 | 100 |
| 6 | 15.0 | 0.056 | 0.50 | Oxygen | 11.8 | 0.43 | 0.26 | 20 | 100 |
| Control | NA | NA | NA | NA | NA | 0.13 | 0.23 | 100 | 81 |

*Blocking plate thickness (mm) to protect backside from treatment.
**COF = Coefficient of friction.
‡% Gelatin layer removed using tests defined above.
NA = Not applicable.

The last line of data in Table I was obtained for a sample of element (Control) that was not glow discharge treated after annealing. The coefficient of friction results clearly indicate that carnauba wax was transferred from the "backside" of the element to the "frontside" during annealing. In the absence of lubricant transfer, the coefficient of friction should be less than about 0.3 on the non-treated "backside", but at least 0.4 on the "frontside" after annealing.

The results shown in Table I indicate that only experiments 1–4 provided removal of substantially all of the transferred lubricant, and the desired adhesion of coating to the treated gel subbing layer. In Experiments 5 and 6, lubricant was successfully removed from the gel subbing layer, but the adhesion (especially wet adhesion) to the applied subbing layer was poor. The reason for the results in Experiments 5 and 6 is that under the given conditions, if the rate of moving the element is too high (15 m/min), poor wet adhesion can result. The Control sample also had very poor adhesion due to the significant transfer of lubricant from the "backside" to the "frontside" during annealing.

Example 2

Glow Discharge Treatment Under Various Conditions to Improve Adhesion

A number of experiments were also carried out to demonstrate various conditions under which glow discharge could be used to remove transferred lubricant and insure acceptable adhesion of layers conventionally used in photographic elements to the treated element. In these experiments, however, the "backside" was not shielded from the glow discharge treatment. Thus, lubricant was removed from the "backside" as well, as indicated by the high coefficient of friction values on the "backside". However, these experiments were intended to demonstrate the glow discharge conditions that are acceptable in practicing the present invention. Once those conditions are known, a skilled artisan would readily understand how to shield or block the "backside" from treatment (for example, as in Example 1).

Several other experiments were also carried out to show conditions under which glow discharge treatment does not acceptably remove the lubricant from the "frontside".

The conditions of treatment and results are presented in Table II below. The element was passed through the glow discharge treatment chamber at 1.2 m/min in all experiments.

TABLE II

| Experiment | Chamber Pressure (Torr) | Energy (joules/cm$^2$) | Gas in Chamber | Gap* | COF** Frontside | COF** Backside | Dry Adhesion | Wet Adhesion# |
|---|---|---|---|---|---|---|---|---|
| 1 | 0.050 | 1.5 | Nitrogen | 17 | 0.08 | 0.08 | very poor | 99 |
| 2 | 0.100 | 5.7‡ | Nitrogen | 17 | 0.08 | 0.08 | very poor | 83 |
| 3 | 0.050 | 16.7‡ | Nitrogen | 17 | 0.39 | 0.55 | excellent | 0 |
| 4 | 0.100 | 4.5 | Nitrogen | 17 | 0.29 | 0.24 | excellent | 26 |
| 5 | 0.050 | 6.8‡ | Oxygen | 17 | 0.34 | 0.49 | excellent | 100 |
| 6 | 0.100 | 1.5 | Oxygen | 17 | 0.33 | 0.15 | fair | 100 |
| 7 | 0.050 | 4.5 | Oxygen | 17 | 0.38 | 0.14 | good | 92 |
| 8 | 0.100 | 8.7‡ | Oxygen | 17 | 0.42 | 0.53 | good | 100 |
| 9 | 0.050 | 8.7‡ | Nitrogen | 33 | 0.21 | 0.53 | fair | 100 |
| 10 | 0.100 | 1.5 | Nitrogen | 33 | 0.41 | 0.11 | excellent | 100 |
| 11 | 0.050 | 4.5 | Nitrogen | 33 | 0.36 | 0.27 | excellent | 100 |
| 12 | 0.100 | 14.2‡ | Nitrogen | 33 | 0.42 | 0.46 | excellent | 100 |
| 13 | 0.050 | 1.5 | Oxygen | 33 | 0.41 | 0.35 | excellent | 95 |
| 14 | 0.100 | 4.0‡ | Oxygen | 33 | 0.34 | 0.14 | good | 58 |
| 15 | 0.050 | 15.9‡ | Oxygen | 33 | 0.32 | 0.47 | excellent | 100 |
| 16 | 0.100 | 4.5 | Oxygen | 33 | 0.37 | 0.25 | excellent | 100 |
| 17 | 0.050 | 16.1‡ | Oxygen | 33 | 0.38 | 0.54 | very poor | 100 |
| 18 | 0.075 | 3.0 | Oxygen | 25 | 0.38 | 0.22 | fair | 82 |

TABLE II-continued

| Experiment | Chamber Pressure (Torr) | Energy (joules/cm$^2$) | Gas in Chamber | Gap* | COF** Frontside | COF** Backside | Dry Adhesion | Wet Adhesion# |
|---|---|---|---|---|---|---|---|---|
| 19 | 0.075 | 3.0 | Nitrogen | 25 | 0.32 | 0.17 | good | 100 |
| 20 | 0.100 | 6.0 | 50:50 $O_2/N_2$ | 25 | 0.48 | 0.46 | excellent | 0 |
| 21 | 0.050 | 3.0 | 50:50 $O_2/N_2$ | 25 | 0.48 | 0.46 | excellent | 74 |
| 22 | 0.150 | 6.0 | Nitrogen | 25 | 0.56 | 0.48 | excellent | 46 |
| 23 | 0.100 | 3.0 | Oxygen | 25 | 0.54 | 0.52 | excellent | 87 |
| 24 | 0.050 | 6.0 | Nitrogen | 25 | 0.52 | 0.50 | excellent | <1 |
| 25 | 0.050 | 9.1 | 50:50 $O_2/N_2$ | 25 | 0.51 | 0.51 | excellent | 93 |
| 26 | 0.100 | 3.0 | Nitrogen | 25 | 0.52 | 0.36 | excelient | 53 |
| 27 | 0.100 | 6.0 | 50:50 $O_2/N_2$ | 25 | 0.52 | 0.48 | excellent | 0 |
| 28 | 0.150 | 9.1 | 50:50 $O_2N_2$ | 25 | 0.55 | 0.50 | excellent | <1 |
| 29 | 0.50 | 6.0 | Oxygen | 25 | 0.52 | 0.47 | excellent | <1 |
| 30 | 0.050 | 3.0 | 50:50 $O_2/N_2$ | 25 | 0.50 | 0.40 | excellent | 86 |
| 31 | 0.100 | 9.1 | Nitrogen | 25 | 0.46 | 0.46 | excellent | 93 |
| 32 | 0.100 | 9.1 | Oxygen | 25 | 0.54 | 0.47 | excellent | 28 |
| 33 | 0.150 | 6.0 | Oxygen | 25 | 0.56 | 0.50 | excellent | 0 |
| 34 | 0.100 | 6.0 | Nitrogen | 25 | 0.49 | 0.43 | excellent | 21 |

*Gap is front side element spacing from cathodes in mm.
**COF = Coefficient of friction
#% Gelatin layer removed using defined test.
‡Direct current energy source (5 KVA), all others alternating current (40 K Hz).

The results listed in Table II show a number experiments in which either the wet or dry adhesion (or both) result was unacceptable (Experiments 1, 2, 4–19, 21–23, 25, 26, 30–32 and 34). Dry adhesion should be "good" or "excellent", and wet adhesion should be less than 20% coating removed. The remaining experiments (3, 20, 24, 27 and 33) provided acceptable adhesion properties. As noted above, lubricant was removed from both sides, but this can be readily corrected using the teaching of Example 1.

The invention has been described in detail with particular reference to preferred embodiments thereof, but it will be understood that variations and modifications can be effected within the spirit and scope of the invention.

We claim:

1. A method for treating an element comprising a support having on both sides thereof a lubricant providing a coefficient of friction of less than about 0.5, said method comprising the step of removing substantially all of said lubricant from only one side of said support.

2. The method of claim 1 wherein said support is a polymeric film or resin-coated paper support, and comprising the additional step of applying a radiation sensitive layer to said only one side of said support from which said lubricant has been removed.

3. The method of claim 1 wherein said element further comprises a magnetic recording layer on said support opposite said only one side from which said lubricant has been removed.

4. The method of claim 1 comprising removing at least 80% of said lubricant from said only one side of said support.

5. The method of claim 1 comprising removing said lubricant from said only one side so that the coefficient of friction of said only one side after lubricant removal is substantially the same as the coefficient of friction of said support having no lubricant thereon.

6. A method for treating an element comprising a support having on both sides thereof a lubricant that provides a coefficient of friction of less than about 0.5, said method comprising the step of removing substantially all of said lubricant from only one side of said support by subjecting said only one side of said support to glow discharge treatment.

7. The method of claim 6 wherein said support is a polymeric film or resin-coated paper support.

8. The method of claim 7 wherein said polymeric film support is composed of a cellulose nitrate, polyester, cellulose ester, polyamide, homo-or copolymer of vinyl chloride, poly(vinyl acetal), polycarbonate, polystyrene, polyolefin, polyacrylate or polyimide.

9. The method of claim 8 wherein said polymeric film support is composed of a polyester selected from the group consisting of polyethylene terephthalate, polyethylene naphthalate, poly-1,4-cyclohexanedimethylene terephthalate, polyethylene 1,2-diphenoxyethane-4,4'-dicarboxylate and polybutylene terephthalate.

10. The method of claim 6 wherein said element comprises a magnetic recording layer on said film support opposite the side treated with said glow discharge treatment, and said lubricant being present as an overcoat on said magnetic recording layer.

11. The method of claim 10 wherein said magnetic recording layer is transparent and comprises a dispersion of ferromagnetic particles in a transparent polymeric binder.

12. The method of claim 6 wherein said element comprises at least one antistatic or subbing layer, or both.

13. The method of claim 6 wherein said lubricant provides a coefficient of friction of less than about 0.3.

14. The method of claim 6 wherein said lubricant provides a coefficient of friction of less than about 0.2.

15. The method of claim 6 wherein said lubricant is a silicone oil or wax, fluorine-containing alcohol, fluorine-containing ester or ether, fluorinated polyalkane, polyolefin, polyglycol alkyl phosphate or alkali metal salt thereof, polyphenyl ether, fluorine-containing alkylsulfate or alkali metal salt thereof, monobasic fatty acid having 10 to 24 carbon atoms or metal salt thereof, alcohol having 12 to 22 carbon atoms, alkoxy alcohol having 12 to 22 carbon atoms, ester of monobasic fatty acid having 10 to 24 carbon atoms, fatty acid ester of monoalkyl ether of alkylene oxide polymer, fatty acid amide having 8 to 22 carbon atoms, aliphatic amine having 8 to 22 carbon atoms, or mixtures thereof.

16. The method of claim 6 comprising the additional step of annealing said element after said glow discharge treatment.

17. The method of claim 6 wherein said glow discharge treatment is carried out at an energy level of at least about 0.5 joules/cm$^2$ at from about 0.001 to about 100 Torr pressure for at least about 0.1 second.

18. The method of claim 17 wherein said glow discharge treatment is carried out at an energy level of from about 0.5 to about 5 joules/cm$^2$ at from about 0.05 to about 0.25 Torr for from about 0.1 to about 10 seconds.

19. The method of claim 6 wherein said element support has disposed thereon at least one subbing, antihalation or antistatic layer on said only one side that is treated to remove said lubricant.

20. A method for preparing a photographic element comprising a polymeric film or resin-coated paper support having on both sides thereof a lubricant that provides a coefficient of friction of less than about 0.5, said method comprising:

A) subjecting only one side of said support to glow discharge treatment for a time and at an energy level sufficient to remove substantially all of said lubricant from that only one side of said support, and B) applying a radiation sensitive layer to said only one side of said support.

21. A method for preparing a photographic element comprising:

A) providing a synthetic polymeric film support having on both sides thereof a lubricant that provides a coefficient of friction of less than about 0.3, B) subjecting only one side of said film support to, glow discharge treatment for at least 0.1 seconds and at least 0.5 joules/cm$^2$ sufficient to remove substantially all of said lubricant from that one side of said film support, and C) coating a radiation sensitive layer on said only one side of said film support.

22. The method of claim 21 further comprising the step of annealing said film support prior to step B.

23. The method of claim 21 further comprising the step of annealing said film support between steps B and C.

24. The method of claim 21 further comprising, prior to step B, applying one or more layers to said film support opposite said only one side subjected to glow discharge treatment, at least one of said applied layers being a transparent magnetic recording layer.

25. The method of claim 21 wherein said glow discharge treatment is carried out at an energy level of from about 0.5 to about 6 joules/cm$^2$ at from about 0.001 to about 100 Torr pressure for from about 0.1 to about 10 seconds in the presence of oxygen, nitrogen, argon, carbon dioxide, ammonia, nitrous oxide or compatible mixtures thereof.

26. The method of claim 21 wherein said polymeric film support is composed of a polyester selected from the group consisting of polyethylene terephthalate, polyethylene naphthalate, poly-1,4-cyclohexanedimethylene terephthalate, polyethylene 1,2-diphenoxyethane-4,4'-dicarboxylate and polybutylene terephthalate, and said lubricant is a silicone oil or wax, fluorine-containing alcohol, fluorine-containing ester or ether, fluorinated polyalkane, polyolefin, polyglycol alkyl phosphate or alkali metal salt thereof, polyphenyl ether, fluorine-containing alkylsulfate or alkali metal salt thereof, monobasic fatty acid having 10 to 24 carbon atoms or metal salt thereof, alcohol having 12 to 22 carbon atoms, alkoxy alcohol having 12 to 22 carbon atoms, ester of monobasic fatty acid having 10 to 24 carbon atoms, fatty acid ester of monoalkyl ether of alkylene oxide polymer, fatty acid amide having 8 to 22 carbon atoms, aliphatic amine having 8 to 22 carbon atoms or mixture thereof.

27. The method of claim 26 wherein said film support is composed of polyethylene naphthalate and said lubricant is carnauba wax.

* * * * *